US007731130B2

(12) United States Patent
Decanio et al.

(10) Patent No.: US 7,731,130 B2
(45) Date of Patent: Jun. 8, 2010

(54) LOUDSPEAKER MOUNTING MECHANISM

(75) Inventors: William Andrew Decanio, Castaic, CA (US); Paul Nelson Adley, Agoura Hills, CA (US); Bernard Hawkins, Long Beach, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

(21) Appl. No.: 10/632,433

(22) Filed: Jul. 31, 2003

(65) Prior Publication Data

US 2004/0164207 A1 Aug. 26, 2004

Related U.S. Application Data

(60) Provisional application No. 60/399,791, filed on Jul. 31, 2002.

(51) Int. Cl.
*G12B 9/00* (2006.01)

(52) U.S. Cl. ..... 248/27.3; 381/386

(58) Field of Classification Search ..... 248/27.1, 248/27.3, 681; 181/141, 150, 199; 174/58; 220/3.5, 3.6; 381/389, 86, 386; 362/364, 362/147, 148

See application file for complete search history.

(56) References Cited

U.S. PATENT DOCUMENTS

| | | | | |
|---|---|---|---|---|
| 1,967,223 | A | 7/1934 | Bostwick | |
| 2,076,034 | A | 4/1937 | Lampman | |
| 2,115,653 | A | 4/1938 | Snyder | |
| 2,455,891 | A | 12/1948 | Flanagan | |
| 2,520,757 | A | 8/1950 | Cain | |
| 2,973,177 | A * | 2/1961 | Stubbs | 248/343 |
| 3,018,082 | A * | 1/1962 | Berger | 248/343 |
| 3,018,083 | A * | 1/1962 | Bobrick | 248/343 |
| 3,052,435 | A | 9/1962 | Roller | |
| 3,128,999 | A | 4/1964 | Schmitt | |

(Continued)

FOREIGN PATENT DOCUMENTS

| | | |
|---|---|---|
| JP | 59-219098 | 12/1984 |

*Primary Examiner*—Korie H. Chan
(74) *Attorney, Agent, or Firm*—The Eclipse Group LLP

(57) ABSTRACT

This invention provides a spring loaded mounting mechanism for easily mounting and removing a loudspeaker housing within an opening in a surface. The mounting mechanism includes a shaft connected to the loudspeaker housing. Attached to the shaft is a spring actuated arm. The actuated arm is compressed inward toward the housing by the side walls of the surface surrounding the opening when the housing is being positioned within the opening. At a certain point when the housing is inserted far enough into the opening, the actuated arm will lose contact with the side walls of the surface surrounding the opening and will expand to its open position. In its open position, the arm is positioned just behind or against the back face of the surface surrounding the opening, locking the housing into the opening in the surface. The invention further allows for the spring actuated arm to be tightened against or moved away from the back face of the surface by adjusting the positioning of the shaft. To remove the housing from the opening, the spring actuated arm may be moved away from the back face of the surface surrounding the opening by compressing the arm inward toward the housing. The arm may be compressed inward through the use of a device or by the hand of a user. Once the arm is compressed inward, the housing may be easily removed from the opening.

18 Claims, 11 Drawing Sheets

U.S. PATENT DOCUMENTS 3,388,247 A * 6/1968 Rackley ..... 362/366
3,575,370 A * 4/1971 Morris et al. ..... 248/201
3,771,621 A 11/1973 Goetti
4,048,491 A * 9/1977 Wessman ..... 362/364
4,053,130 A * 10/1977 Birkner ..... 248/27.3
4,066,058 A 1/1978 Anderkay
4,120,473 A * 10/1978 Suk ..... 248/27.1
4,289,929 A 9/1981 Hathaway
4,306,708 A 12/1981 Gassaway et al.
4,522,378 A 6/1985 Nelson
4,546,850 A * 10/1985 Litner ..... 181/141
4,783,039 A 11/1988 Peterson et al.
4,858,880 A 8/1989 Durand
4,919,369 A * 4/1990 Stehn ..... 248/27.3
4,921,203 A 5/1990 Peterson et al.
5,077,650 A * 12/1991 Cestari ..... 362/365
5,110,081 A 5/1992 Lang, Jr.
5,115,884 A 5/1992 Falco
5,122,944 A * 6/1992 Webb ..... 362/365
5,141,203 A 8/1992 Baker et al.
5,303,896 A 4/1994 Sterka
5,374,103 A * 12/1994 Stange et al. ..... 297/188.16
5,410,782 A * 5/1995 Holyoake ..... 24/505
5,570,867 A 11/1996 Norkus
5,726,395 A 3/1998 Anagnos
5,931,432 A * 8/1999 Herold et al. ..... 248/343
5,961,193 A * 10/1999 Hobbs ..... 312/333
6,007,028 A * 12/1999 Lin ..... 248/27.3
6,023,812 A * 2/2000 Morad ..... 15/257.7
6,132,069 A * 10/2000 Sato et al. ..... 362/365
6,173,064 B1 1/2001 Anagnos
6,241,368 B1 * 6/2001 Depino ..... 362/364
6,354,578 B1 3/2002 Nakatsukasa et al.
6,550,570 B2 4/2003 Combest
6,554,458 B1 * 4/2003 Benghozi ..... 362/365
6,561,312 B2 5/2003 Stanienda
6,588,543 B1 * 7/2003 Tchilinguirian ..... 181/150
6,744,903 B1 6/2004 Jeon
6,883,940 B2 * 4/2005 Grajetzky et al. ..... 362/364
6,904,157 B2 6/2005 Shima
2003/0016493 A1 1/2003 Hiratomo et al.

* cited by examiner

LOUDSPEAKER MOUNTING MECHANISM

This application claims priority to U.S. Provisional Application Serial No. 60/399,791 filed on Jul. 31, 2002, which is incorporated into this application by reference.

BACKGROUND OF THE INVENTION

1. Field of the Invention.

This invention generally relates to the field of loudspeakers. In particular, the invention relates to a system capable of latching the loudspeaker housing within a surface.

2. Related Art.

Installing a loudspeaker into a surface such as a wall and/or ceiling generally includes cutting an opening into the surface to insert the loudspeaker housing into the opening. The loudspeaker housing may be flush against the surface and have a recessed area to receive a baffle that covers the opening and loudspeaker housing. The baffle may incorporate at least one loudspeaker. The loudspeaker housing may be first secured in the surface and then the baffle (with at least one loudspeaker) may be secured to the loudspeaker housing.

At present, mounting a loudspeaker housing within a surface generally includes placing the loudspeaker housing within an opening in the surface and attaching the loudspeaker housing to the opening. Attaching typically involves utilizing some type of attaching means such as screws, nails or adhesive. However, this approach is difficult because it requires the loudspeaker to be placed into proper position within the opening in the surface and to be properly attached to the opening while maintaining the proper position. Additionally, this approach is generally inflexible and permanent in nature because once the loudspeaker housing is attached to the opening it is difficult to reposition the loudspeaker housing or remove it without significant effort or potential damage to the surface. Therefore, there is also a need for a mounting mechanism that is capable of easily mounting a loudspeaker housing within a surface.

SUMMARY

This invention provides a spring loaded mounting mechanism for easily mounting and removing a loudspeaker housing within an opening in a surface. A shaft is connected to the loudspeaker housing. Attached to the shaft is a spring loaded mounting mechanism. The spring loaded mounting mechanism includes a spring actuated arm member that has a beginning or open position. When the spring actuated arm member comes in contact with the side wall of the surface, the spring actuated arm member compresses inward toward the housing. Once the housing is positioned far enough in the opening, the spring loaded arm loses contact with the side wall of the surface and expands back to its original open position. When expanded to the open position, the arm aligns with the back side of the surface surrounding the opening. This locks the housing into place within the opening of the surface.

The interface between the spring actuated arm and the back side or face of the surface surrounding the opening may be tightened or loosened by adjusting the positioning of the shaft. The shaft may be designed as a threaded shaft that may be rotated to tighten or loosen the position of the mounting mechanism relative to the housing and/or the back face of the surface surrounding the opening.

The back panel of the housing may be open. To remove the housing, the spring actuated arm may be moved away from the back face of the surface surrounding the opening by compressing the arm inward toward the housing. The arm may be compressed inward through the use of a device or by the hand of a user.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
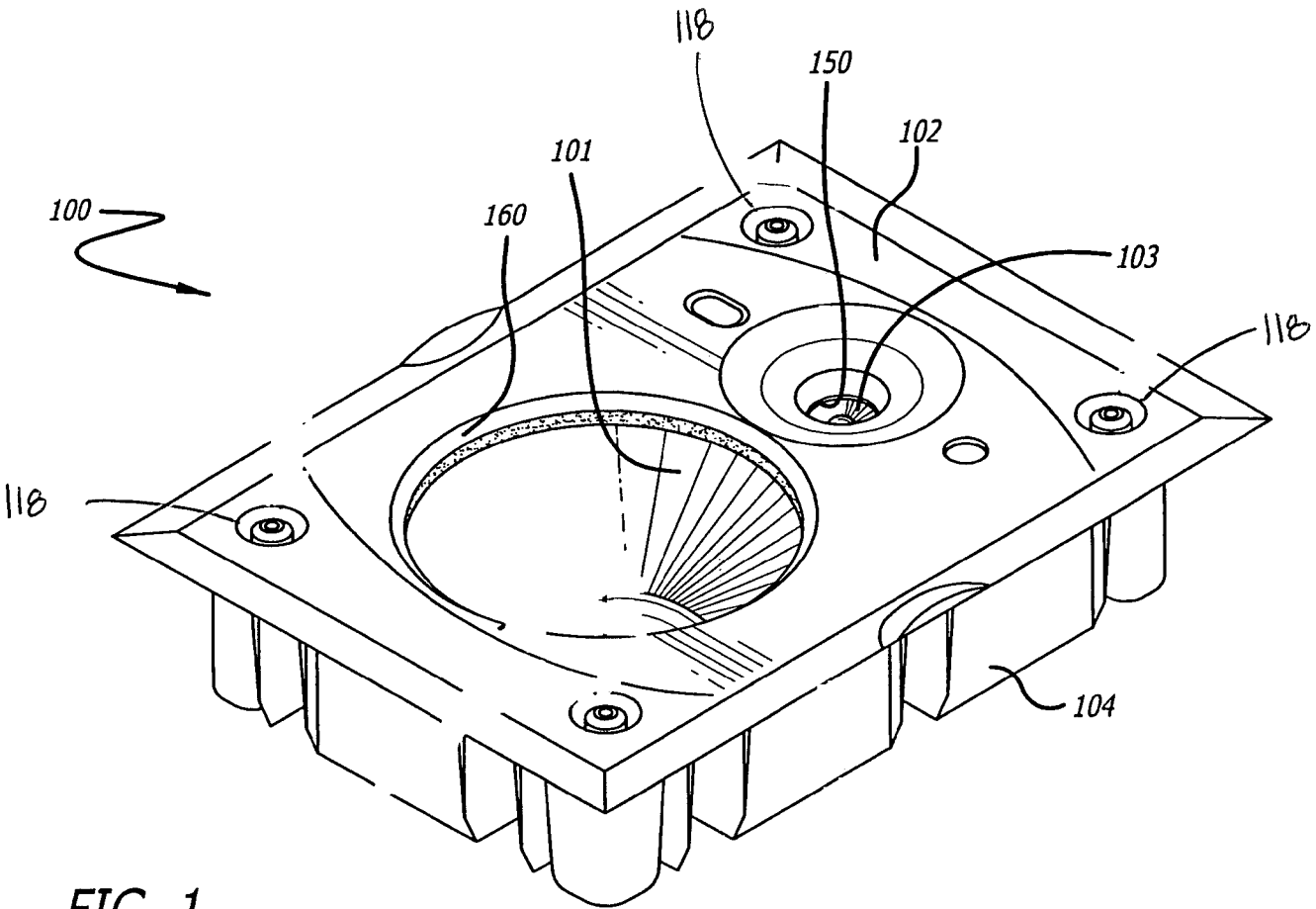
FIG. 1 is a perspective view of a loudspeaker mounting mechanism for mounting a loudspeaker within a surface.

FIG. 1 is a perspective view of a loudspeaker containment system 100 capable of being mounted within an opening in a surface (not shown), such as a wall or ceiling. As illustrated by FIG. 1, the loudspeaker containment system 100 includes a housing 104, which may be inserted into an opening formed in a wall or other surface. The loudspeaker housing 104 is generally positioned flush against the surface and includes a baffle 102 that is positioned within a recessed area in the loudspeaker housing 104. The baffle 102 will generally include at least one opening 160 for receiving and incorporating at least one loudspeaker 101. As illustrated, the baffle 102 may also include a second opening 150 for receiving a second loudspeaker transducer 103, such as a tweeter. Furthermore, each baffle 102 may include four isolation openings 118 at each of its corners for securing the baffle 102 to the housing 104.

Figure 2:
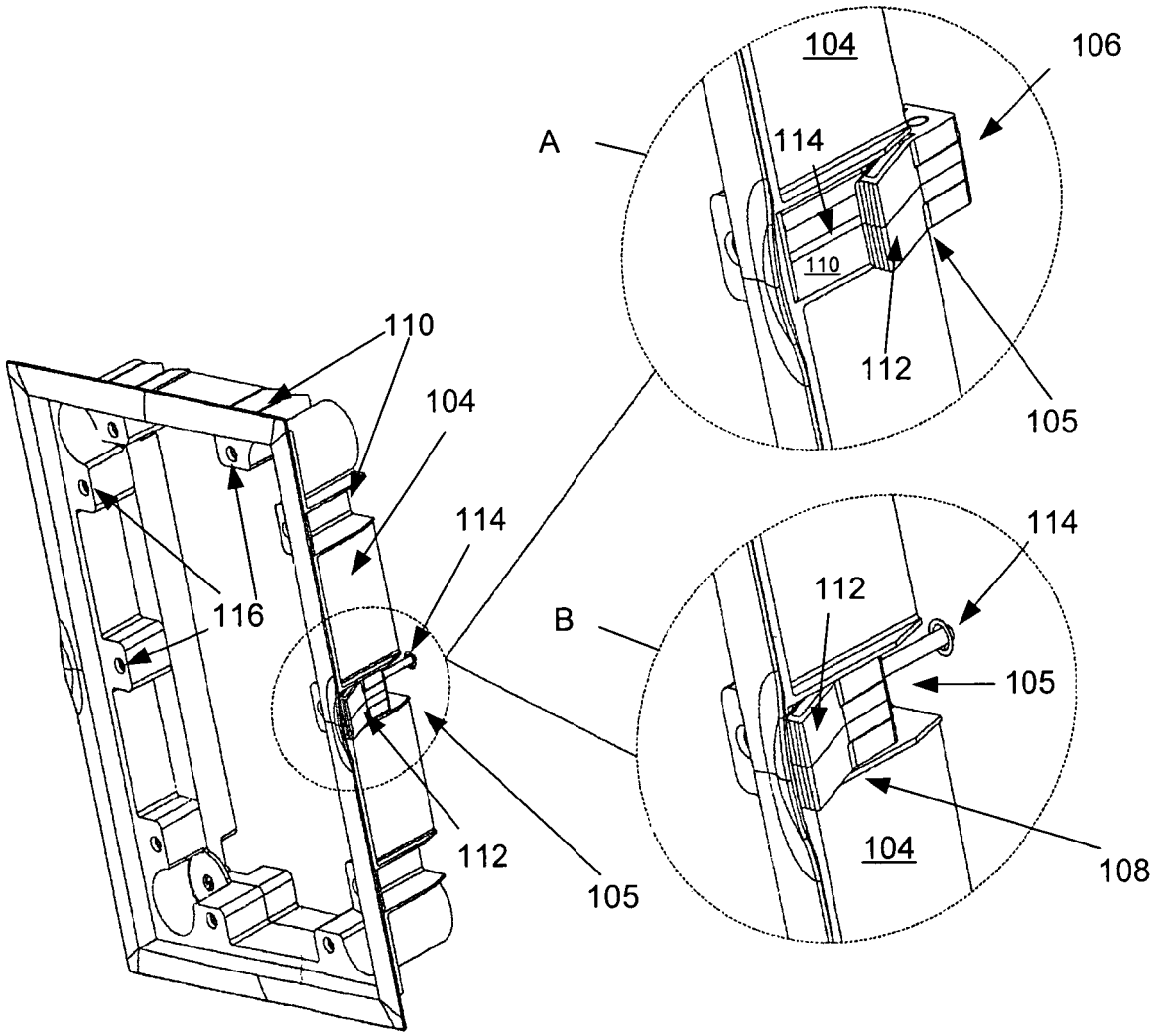
FIG. 2 is a perspective view of the loudspeaker housing showing an example implementation of a mounting mechanism.

FIG. 2 is a perspective view of the loudspeaker housing 104 showing an example implementation of a mounting mechanism 105 capable of securing the housing 104 within an opening in a surface (not shown). As illustrated in FIG. 2, the housing is designed with recesses 110 for receiving the mounting mechanism 105. While FIG. 2 only illustrates the use of one mounting mechanism 105 centrally located along one side of the housing 104, any number of mounting mechanisms may be utilized in connection with the housing 104. For example, the housing illustrated in FIG. 2 is designed with ten recesses 110 for receiving mounting mechanisms 105. Two recesses 110 are located on the top of the housing 104, two are located on the bottom of the housing 104 and three recesses 110 are located on each side of the housing 104. All the recesses 110 are capable of receiving a mounting mechanism 105. The placement and number of the mounting mechanisms 105 used in connection with a housing 104 may vary depending upon design choice or subjective factors known to those skilled in the art, such as the size of the housing 104, the type of the surface surrounding the opening or the placement or orientation in which the loudspeaker containment system 100 is to be mounted.

As will be illustrated in more detail below, each mounting mechanism 105 includes a mounting clip 112 that is retained within the recesses 110 of the housing 104 by a shaft 114. The recesses 110 extend inward toward the interior of the housing 104.The shaft 114 may be positioned through an opening 116 at the top of the recess 110 such that the shaft 114 extends downward into the recess 110 to engage the mounting clip 112. The shaft 114 may be a threaded screw that may be rotated to adjust the positioning of the mounting mechanism 105 along the recess 110. For example, sub-view A shows an extended position 106 of the mounting mechanism 105 within the recess 110 and sub-view B shows a retracted position 108 of the mounting mechanism 105 along the recess 110 of the housing 104. As will be explained in more detail below, sub-view A generally represents the position of the mounting mechanism 105 prior to its placement within an opening. Sub-view B generally represents the general position of the mounting mechanism 105 after it has been positioned within the opening. When positioned within the opening, the outer edge of the mounting clip 112 is positioned just behind the back face of the surface surrounding the opening. Moving the mounting mechanism 105 to its retracted position brings the edge of the mounting clip 112 closer to the back face of the surface so that it may engage the back face of the surface and securely maintain the housing 104 within the opening in the surface.

Figure 3:
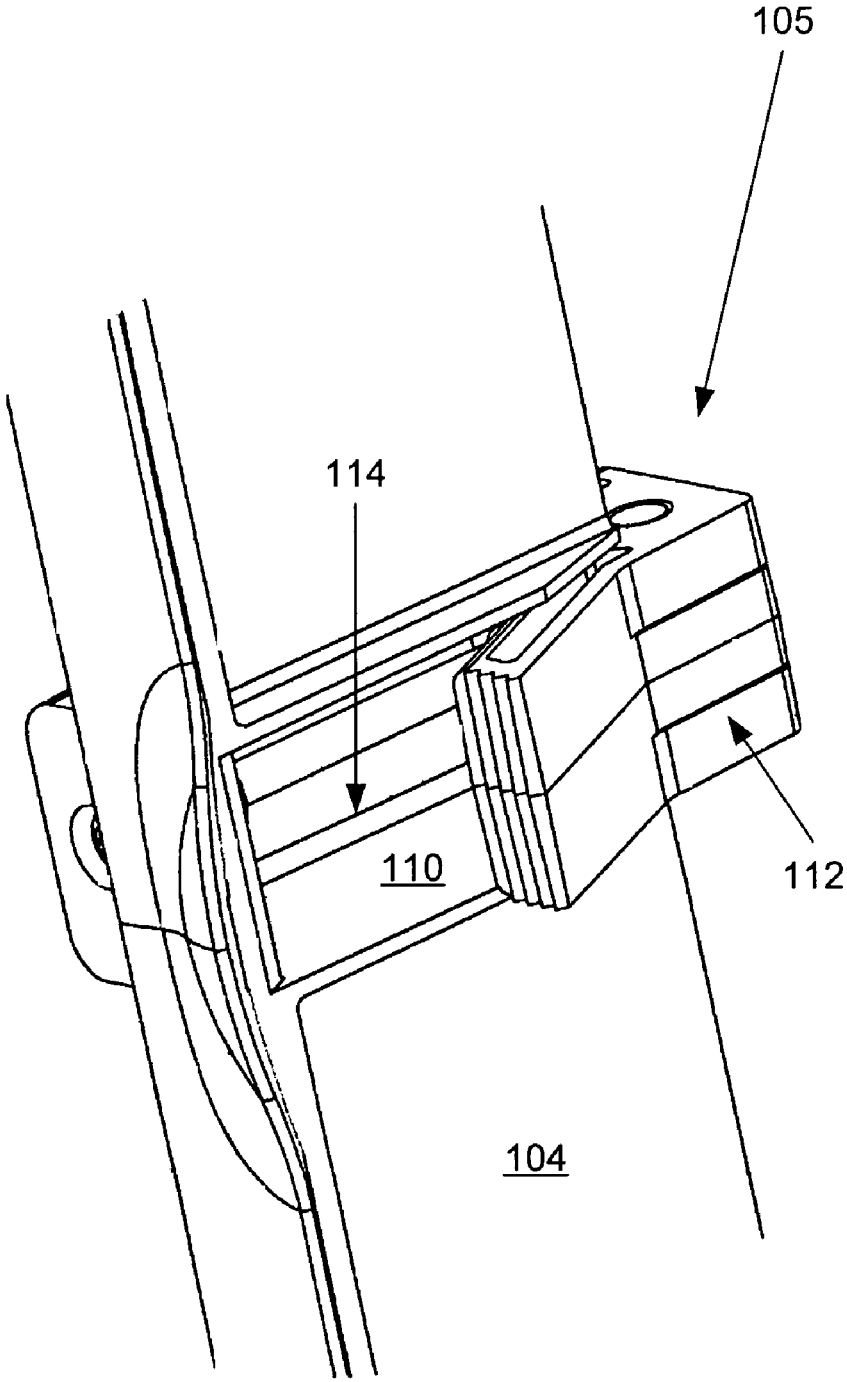
FIG. 3 is a perspective view illustrating an extended position of the mounting mechanism shown in sub-view A of FIG. 2.

FIG. 3 is a perspective view of the extended position 106 of the mounting mechanism 105 shown in sub-view A of FIG. 2. As illustrated by FIG. 3, the mounting clip 112 of the mounting mechanism 105 is positioned toward the rear of the housing 104.

Figure 4:
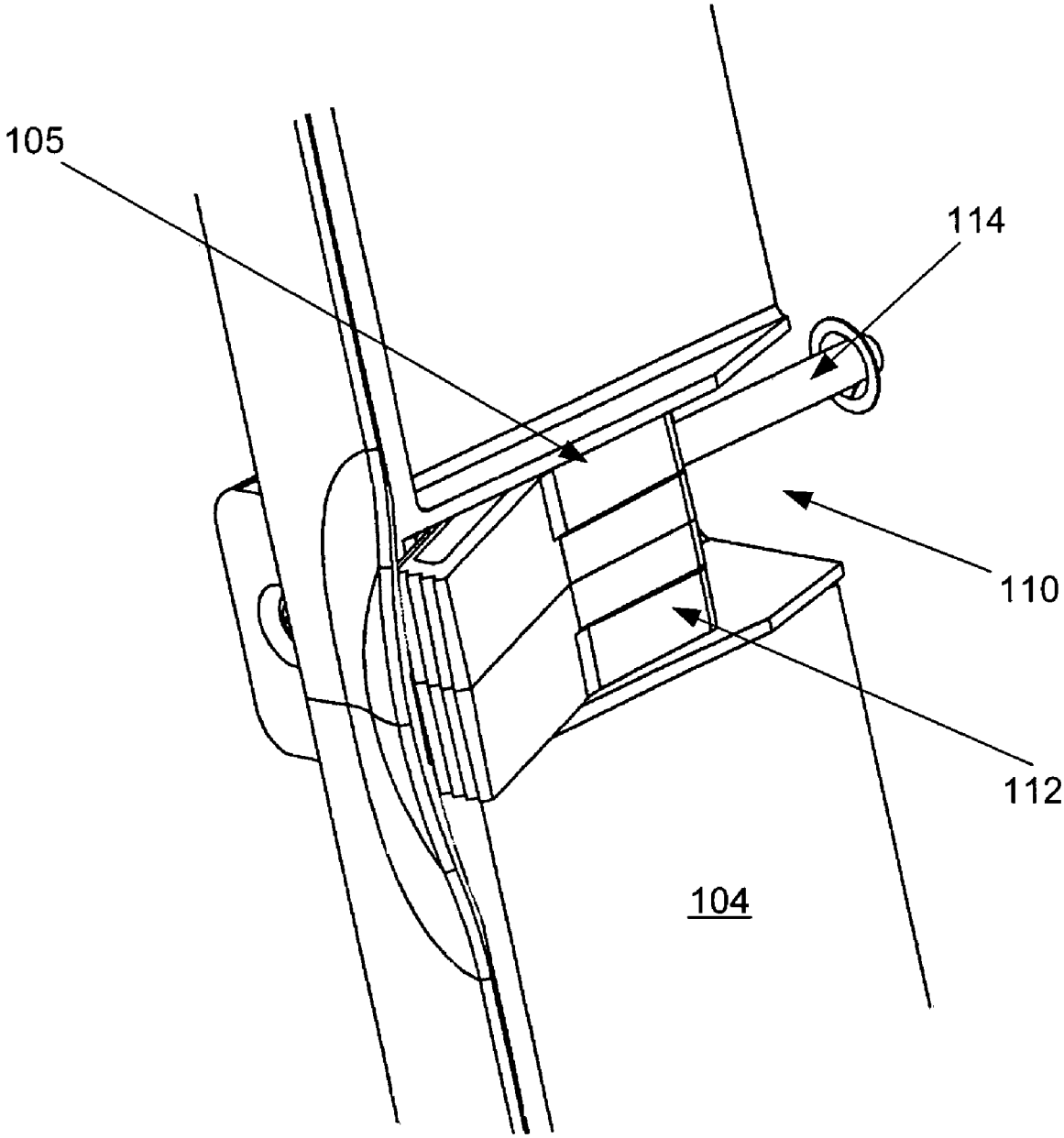
FIG. 4 is a perspective view illustrating a retracted position of the mounting mechanism shown in sub-view B of FIG. 2.

In comparison, FIG. 4 is a perspective view of the retracted position 108 of the mounting mechanism 105 shown in sub-view B of FIG. 2. The mounting clip 112 of the mounting mechanism 105 is positioned forward in the recess 110 toward the front of the housing 104. Moving the mounting clip 112 rearward and forward may be accomplished by adjusting the shaft 114 on which the mounting clip 112 is mounted. The shaft 114 may be adjusted at the point at which the shaft 114 is inserted through an opening 116 at the top of the recess 110. For example, if the shaft 114 is a screw, one could move the mounting clip 112 forward and rearward by turning the head of the screw, which may be exposed in the interior portion of the housing 104 at the top of the recess 110.

Figure 5:
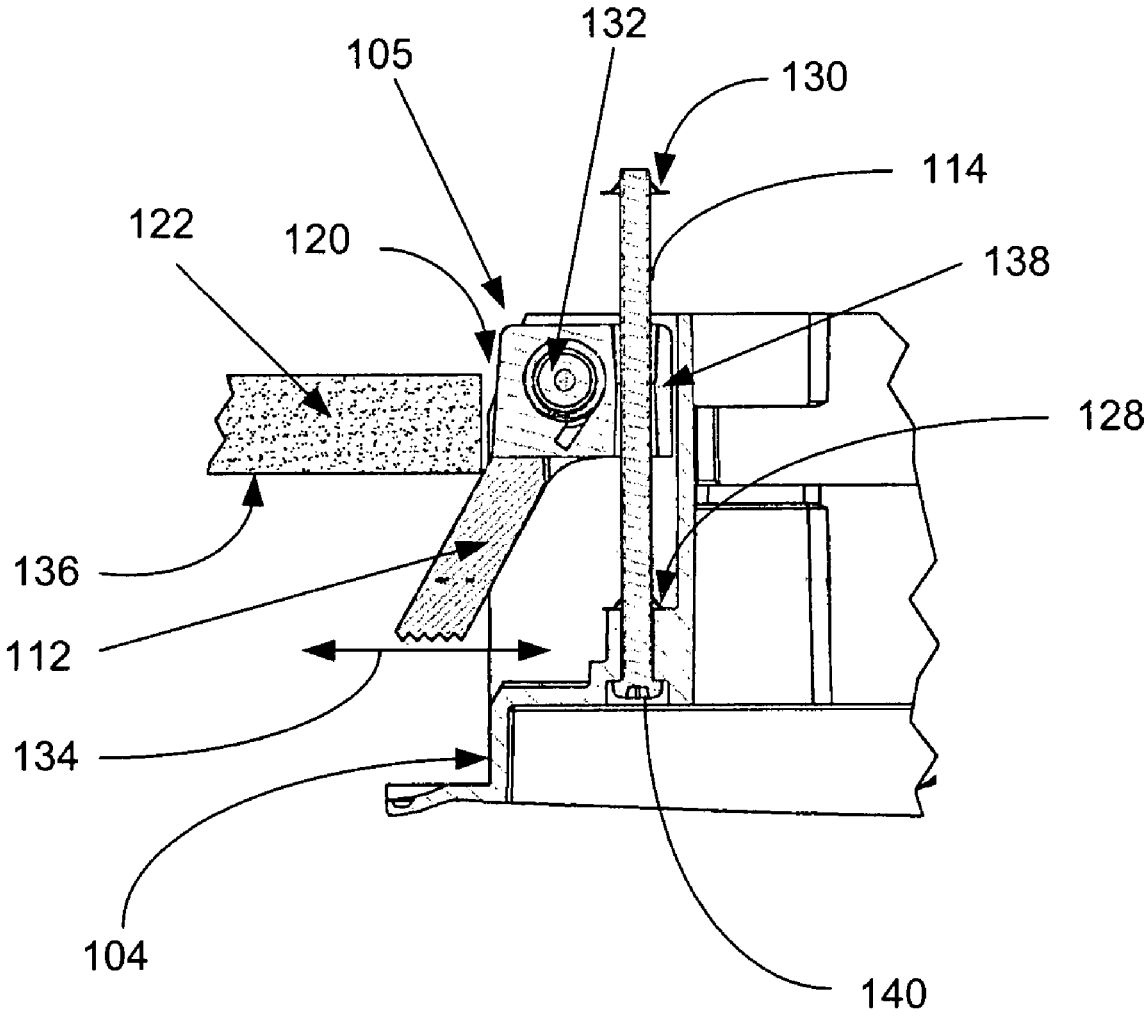
FIG. 5 is a cross-section view of an example implementation of the mounting mechanism of FIG. 2 attached to the loudspeaker housing before inserting the loudspeaker housing into an opening within a surface.

FIG. 5 is a cross-section view of an example implementation of the mounting mechanism 105 of FIG. 2 attached to the loudspeaker housing 104 as it is initially being inserted into an opening 120 within a surface 122. The mounting mechanism 105 may include a shaft 114, a mounting clip 112 and a spring mechanism 132. The shaft 114 may include a top limit 128 and a bottom limit 130. The mounting clip 112 may be arm member (also known as a radial member) that is capable of moving in a lateral direction in a geometric plane 134 that is tangential to the face 136 of the surface 122. The lateral movement of the mounting clip 112 may be a result of interfacing with the opening 120 of the surface 122 and the spring mechanism 132. The mounting clip 112 may be partially or totally composed of teflon®, nylon, delrin®, wood, rubber, metal, plastic, fiberglass, epoxy resin, or any other similar structural material capable of providing structural rigidity.

The shaft 114 is connected to the loudspeaker housing 104 and the mounting clip 112. The shaft 114 may be any structural element capable of moving the mounting clip 112 rearward and forward relative to the face 136 of the surface 122. The shaft 114 generally functions to extend or retract the mounting clip 112 along the recess 110 of the loudspeaker housing 104 relative to the face 136 of the surface 122. The shaft 114 may include top and bottom limits 128 and 130. The top limit 128 and bottom limit 130 may act to limit the range of motion of the mounting mechanism 105 along the shaft 114. Examples of the top limit 128 and bottom limit 130 may include washers or other similar parts. The top limit 128 and bottom limit 130 may be part of the shaft 114 or separate parts connected to the shaft 114. As an example, the shaft 114 may be threaded similar to a screw. In this example, the mounting clip 112 may have an interface section 138 that is connected to the shaft 114. The interface section 138 may be part of the mounting clip 112 or a separate part that is connected to the shaft 114 and the mounting clip 112 via the spring mechanism 132. In an example operation of the mounting mechanism 105, the mounting clip 112 may move rearward along the shaft 114 in response to rotating the shaft 114 in one example direction and forward along shaft 114 in response to rotating the shaft 114 in the opposite direction. In the example of a threaded shaft 114, the shaft 114 may have a shaft head 140, such as a screw head, capable of rotating the shaft 114. The shaft 114 may be partially or totally composed of teflon®, nylon, delrin®, wood rubber, metal, plastic, fiberglass, epoxy resin, or any other similar structural, material capable of providing structural rigidity.

Figure 6:
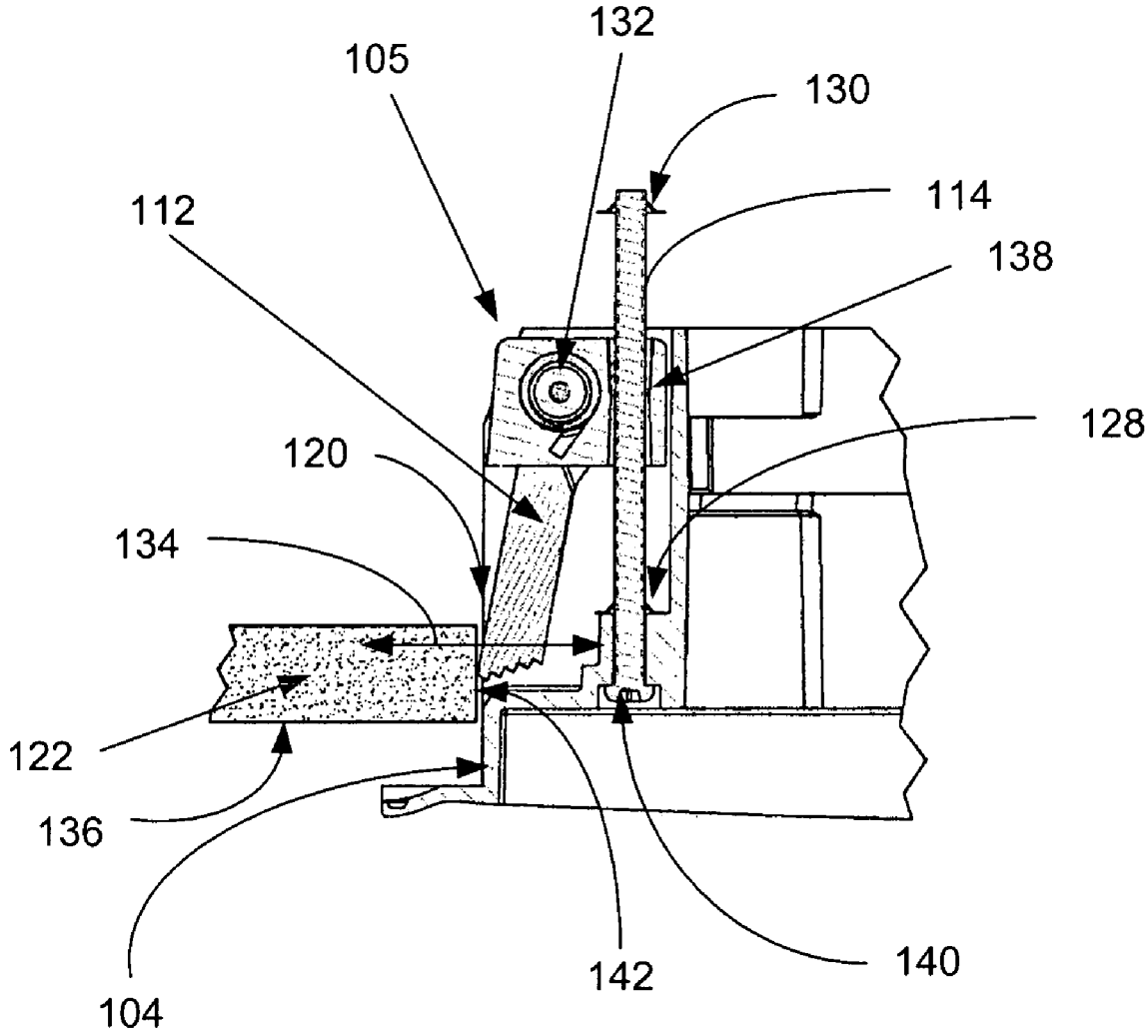
FIG. 6 is a cross-sectional view of the loudspeaker housing and mounting mechanism partially within the opening.

FIG. 6 is a cross-sectional view of the loudspeaker housing 104 and mounting mechanism 105 partially within the opening 120. In FIG. 6, the loudspeaker housing 104 is moved partially into the opening 120. In FIG. 6, the mounting clip 112 moves in a tangential direction 134 toward the loudspeaker housing 104 in response to the pressure caused by the side wall or edge 142 of the surface 122 in the opening 120. In other words, the mounting clip 112 is being compressed inward toward the housing 104. As an example of operation, the spring mechanism 132 is compressed by the mounting clip 112 in response to the pressure from the edge 142 of the surface 122 surrounding the opening. It is appreciated by those skilled in the art that the compression of spring mechanism 132 produces a spring force that opposes pressure caused by the edge 142.

Figure 7:
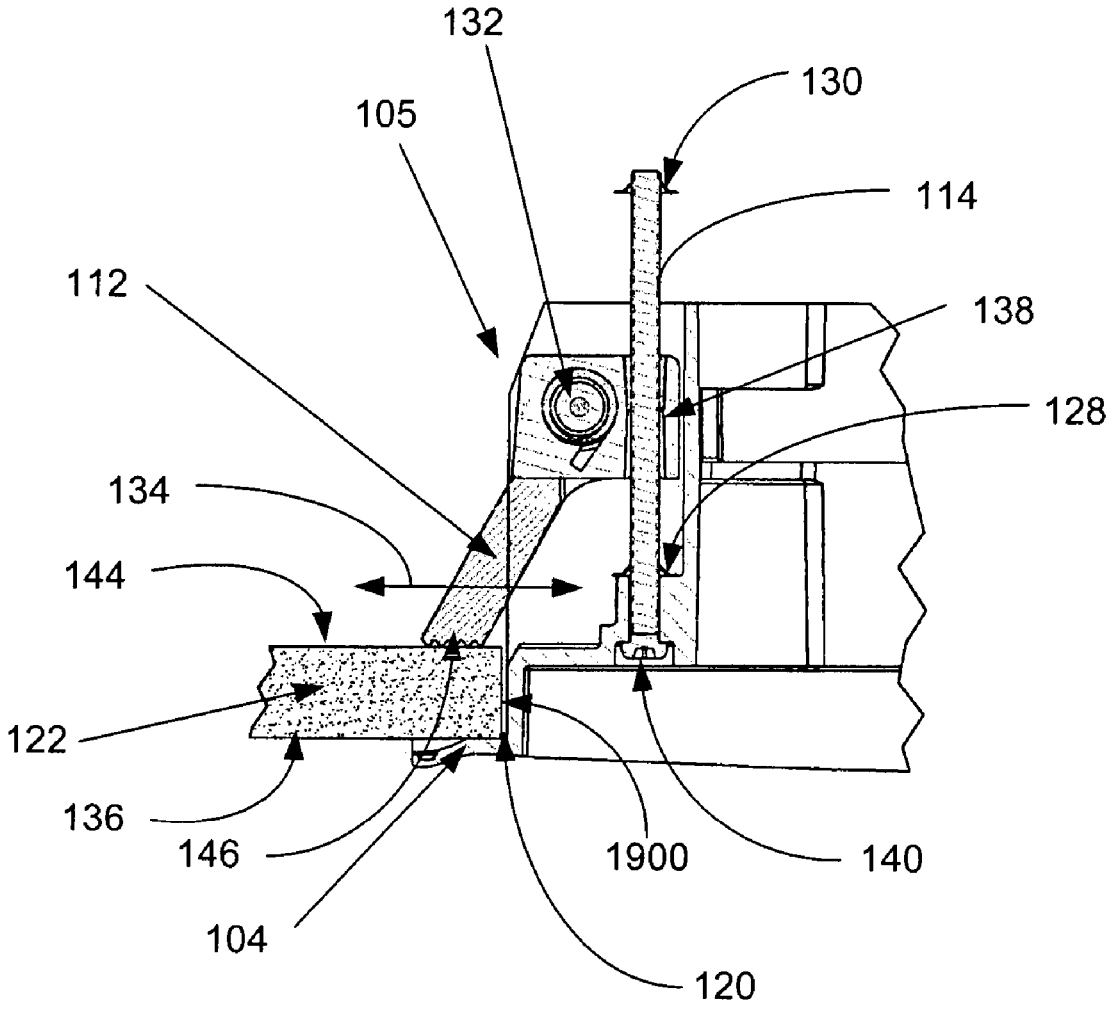
FIG. 7 is a cross-sectional view of the loudspeaker housing and mounting mechanism completely within the opening.

FIG. 7 is a cross-sectional view of the loudspeaker housing 104 and mounting mechanism 105 positioned completely within the opening 120. In FIG. 7, once the loudspeaker housing 104 is placed within the opening 120 at a point in which the mounting clip 112 clears the edge 142, the spring mechanism 132 causes the mounting clip 112 to move in the opposite lateral direction 134 from that in FIG. 6. It could also be said that the mounting clip 112 returns to its open position, whereas it is in a closed position when compressed inward by the edge 142 of the surface 122 of the opening 120. As a result, when the spring of the spring mechanism 132 returns back to an uncompressed state, the position of mounting clip 112 is located behind or adjacent to the back face 144 of the surface 122. Once the mounting clip 112 is located in this position, the shaft 114 may be utilized to move the mounting clip 112 forward to a position that engages the back face 144 of the surface 122. The mounting clip 112 may include an attachment edge 146 for engaging the back face 144 of the surface 122. As illustrated by FIG. 7, the attachment edge 146 may be formed to have grooves or teeth to help secure the tip of the mounting clip 112 to the back face 144 of the surface 122. The shaft 114 may then be utilized to tighten the interface between the attachment edge 146 and the back face 144 to any desired level. In the case of a threaded shaft 114, the shaft head 140 may be rotated as necessary. In the case of a sliding shaft 114, the shaft head 140 may be pulled outward toward the face 136 of the surface 122.

Removal of the loudspeaker housing 104 from the opening 120 is accomplished in a similar manner as the insertion of the housing 104 in the opening 120. If the mounting clip 112 has been tightly secured against the back face 144 of the surface 122, prior to removing the housing 104, it may be desirable to extend the mounting clip 112 rearward, away from the back face 144 of the surface 122 by adjusting the shaft 114. Once the mounting clip 112 has been moved away from the back face 144 of the surface 122, the mounting clip 112 may be compressed in toward the loudspeaker housing 104 by a device or the hand of a user. The back of the housing 104 may be open, as illustrated in FIG. 2, to allow for a device or for a user to reach around the exterior perimeter of the housing 104 and engage the mounting clip 112. Once the mounting clip 112 is compressed, the loudspeaker housing 104 may be removed from the opening 120 by pulling the loudspeaker housing 104 out of the opening 120.

While any type of spring mounted mechanism capable of compressing when inserted into the opening and expanding to interface with the back face or side of the surrounding surface may utilized, FIGS. 8-14 provide one example implementation of a mounting clip that may be used in connection with the mounting mechanism of the invention.

Figure 8:
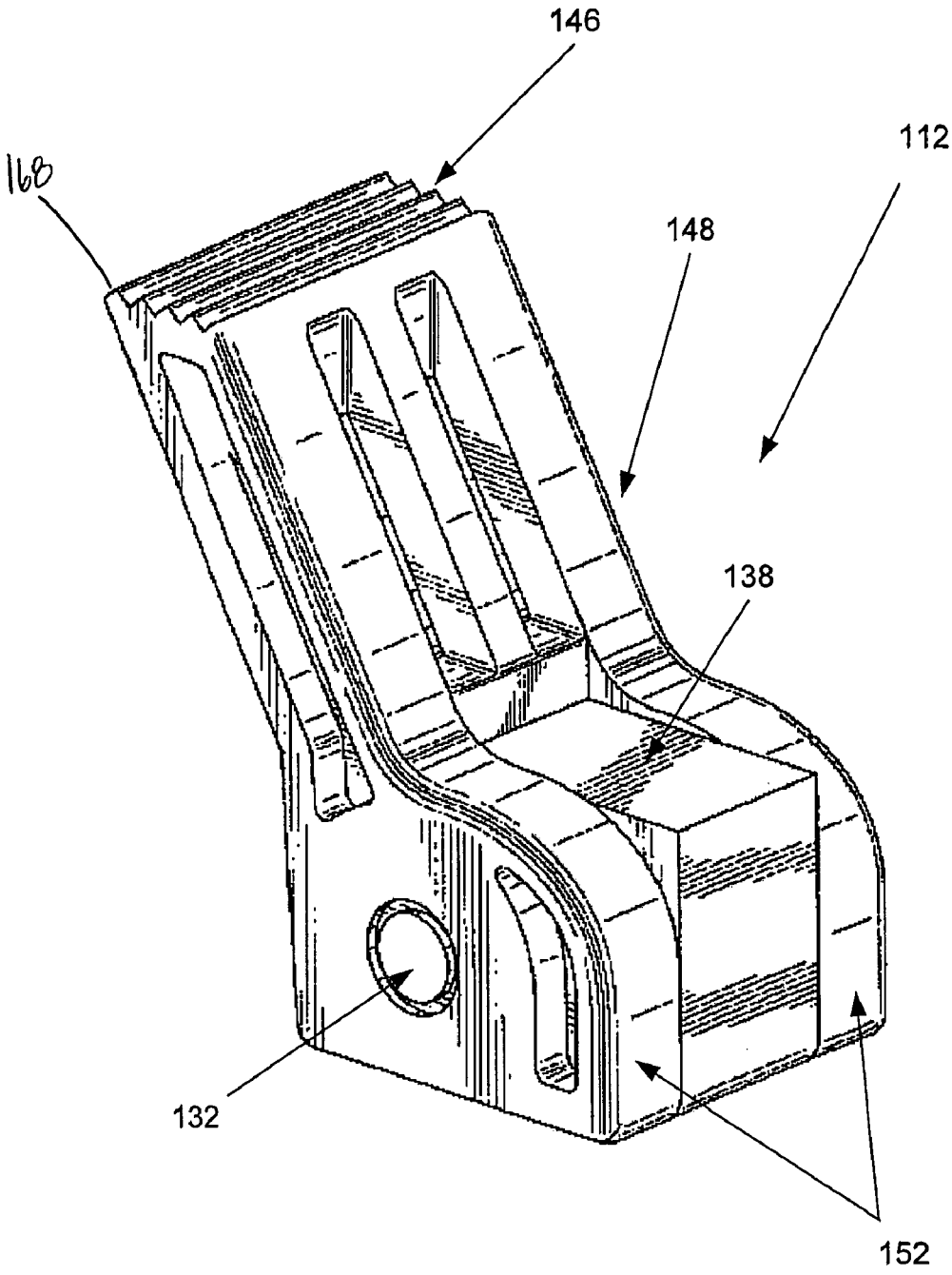
FIG. 8 is a front perspective view of an example mounting clip shown in FIG. 2.

FIG. 8 is a front perspective view of an example mounting clip 112 shown in FIG. 2. As illustrated by FIG. 8, the mounting clip 112 may include an arm portion 148, a spring mechanism 132, and an interface section 138 for connection to the shaft 114. As previously discussed, the interface section 138 may be part of the mounting clip 112 or a separate part that is connected to the shaft 114 and the mounting clip 112 via the spring mechanism 132. In operation, the interface section 138 remains stationary relative to the arm portion 148 of the mounting clip 112. The interface section 138 is mounted to the shaft 114 and the spring mechanism 132 would extend between the arm portion 148 and the interface section 138, such that the arm portion 148 would move relative to the mounting clip 112 via the spring mechanism 132 when the arm portion 148 is compressed and released. In this embodiment, the interface section 138 is positioned in a central cavity at the base of the arm portion 148; however, the arm portion 148 may be designed to receive or be connected to the interface section 138 in a different location, such as on one side of the arm portion 148.

The mounting clip 112 may further include an attachment edge 146 located at the top edge or tip of the mounting clip 112 for engaging the back face 144 of the surface 122 surrounding the opening 120. As illustrated, the attachment edge 146 may be formed to have grooves 168 or teeth to help secure the top edge of the mounting clip 112 to the back face 144 of the surface 122. As previously discussed, the mounting clip 112 may be partially or totally composed of teflon®, nylon, delrin®, wood, rubber, metal, plastic, fiberglass, epoxy resin, or any other similar structural material capable of providing structural rigidity.

Figure 9:
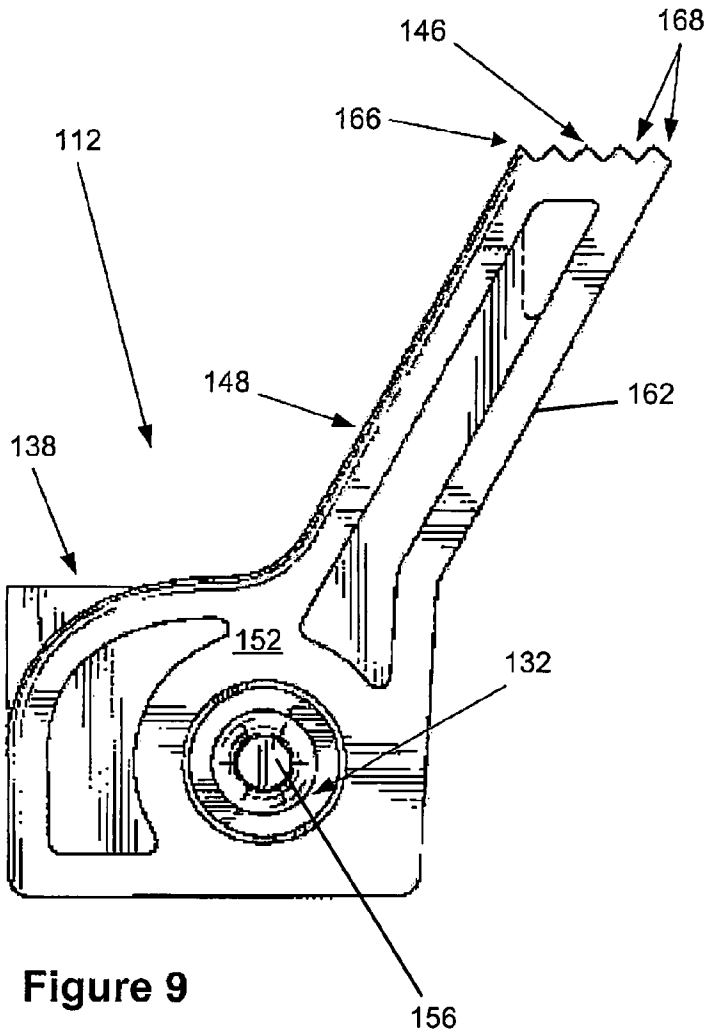
FIG. 9 is a side elevational view of one side of the example mounting clip shown in FIG. 8.

FIG. 9 is a side elevation view of one side of the example mounting clip 112 shown in FIG. 8. As illustrated by FIG. 9, the arm portion 148 may have a base section 152 for receiving or communicating with an interface section 138 via a spring mounting mechanism 132. A post (e.g., a shaft, boss, pin, axle, etc.) 156 may extend between the base section 152 and the interface section 138 (see also FIG. 12), whereby the arm portion 148 and the base section 152 pivot about the axis of the post 156 relative to the interface section 138. The arm portion 148 may further include an extended portion 162 that extends upward and is angled slightly outward and away from the base section 152, such that the mounting clip 112, when in its open position, can engage the back face 144 of the surface 122 surrounding the opening 120. The top the extended portion 162 may include a horizontal or flat landing 166, which can be designed to assist in engaging the back face 144 of the surface 122 surrounding the opening 120 when used to secure a housing 104 within an opening 120.

Figure 10:
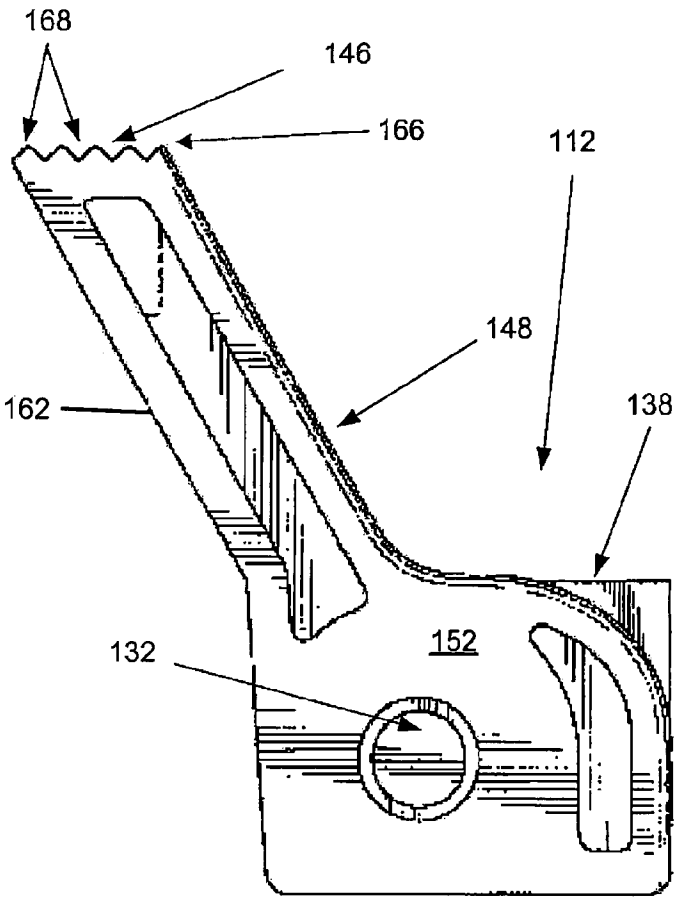
FIG. 10 is a side elevational view of the other side of the example mounting clip shown in FIG. 8.

FIG. 10 is a side elevation view of the other side of the example mounting clip 112 shown in FIG. 8. Similar to FIG. 9, FIG. 10 illustrates the mounting clip 112 having a base section 152 and extended portion 162 that extends upward and that is angled outward, slightly away from the base section 152. While the interface section 138 is depicted in FIGS. 8-10 as being a generally rectangular block, the shape, design and position of the interface section 138 may be varied according to design preferences.

Figure 11:
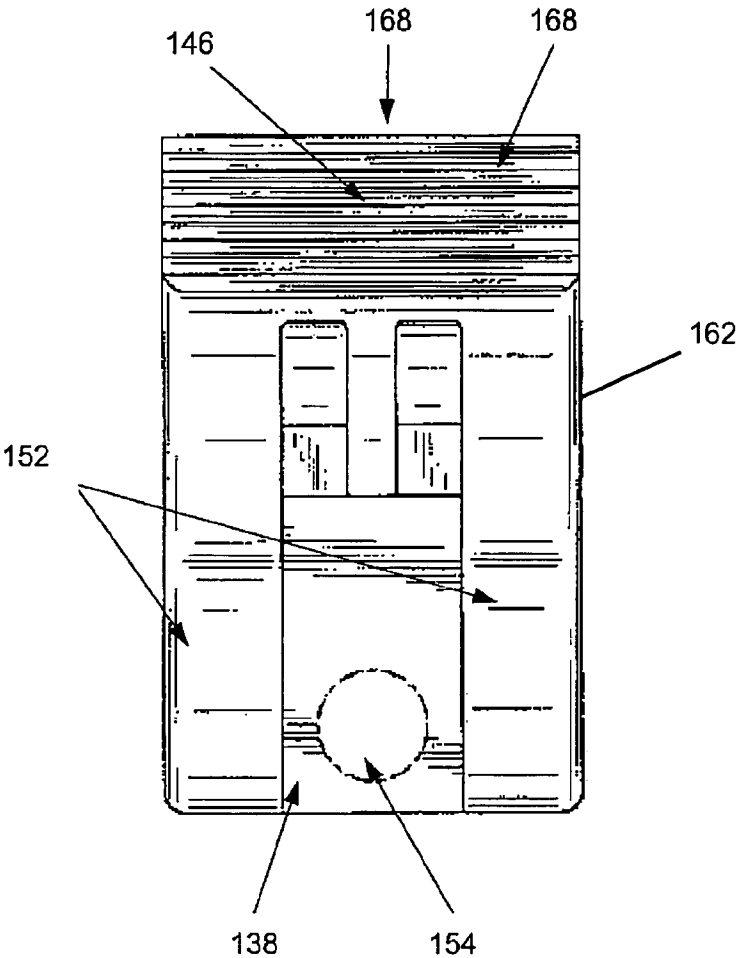
FIG. 11 is a top plan view of the example mounting clip shown in FIG. 8.

FIG. 11 is a top plan view of the example mounting clip 112 shown in FIG. 8. FIG. 11 shows the interface section 138 having a bore 154 extending through its central region. This bore 154 is designed to engage and receive the shaft 114 of the mounting mechanism 105. If the shaft 114 is a threaded shaft, the bore 154 may also be threaded to receive the shaft 114 and to provide for the mounting clip 112 to move up and down the shaft 114, in an extended and retracted position 106 and 108 about the housing 104, depending upon the rotational direction of the shaft 114. Also illustrated in FIG. 11 is the generally flat landing portion 166 of the extended arm portion 148. The flat portion 166 may include grooves 168 for enhancing its ability to engage the back face 144 of the surface 144 surrounding the housing 104.

Figure 12:
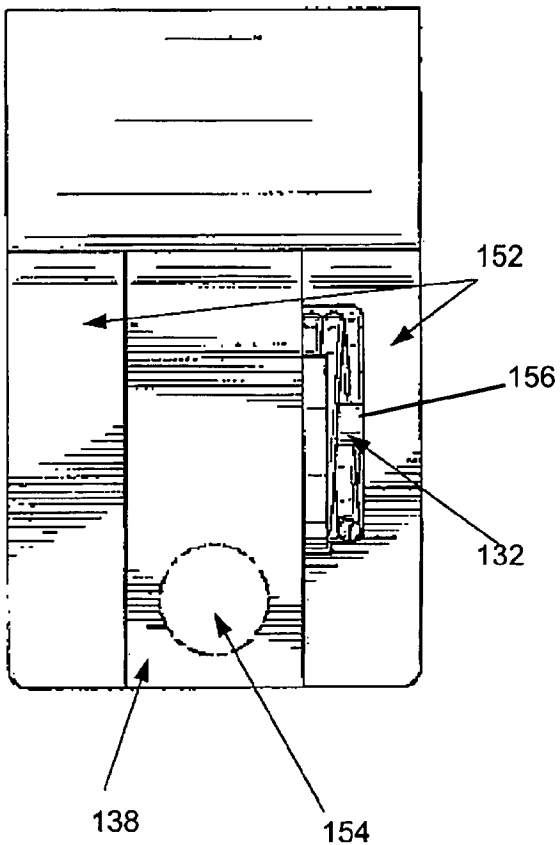
FIG. 12 is a bottom plan view of the example mounting clip shown in FIG. 8.

FIG. 12 is a bottom plan view of the example mounting clip 112 shown in FIG. 8. FIG. 12 further illustrates that the bore 154 in the interface section 138 extends entirely through the base section 152 of the mounting clip 112.

Figure 13:
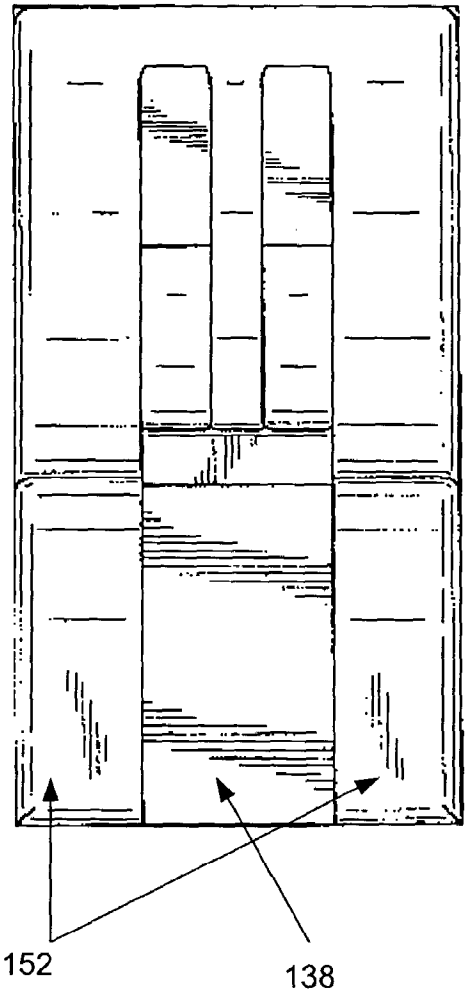
FIG. 13 is a front elevational view of the example mounting clip shown in FIG. 8.

FIG. 13 is a front elevation view of the example mounting clip 112 shown in FIG. 8. FIG. 13 illustrates the interface section 138 of this embodiment being positioned central to the base section 152 of the mounting clip 112.

Figure 14:
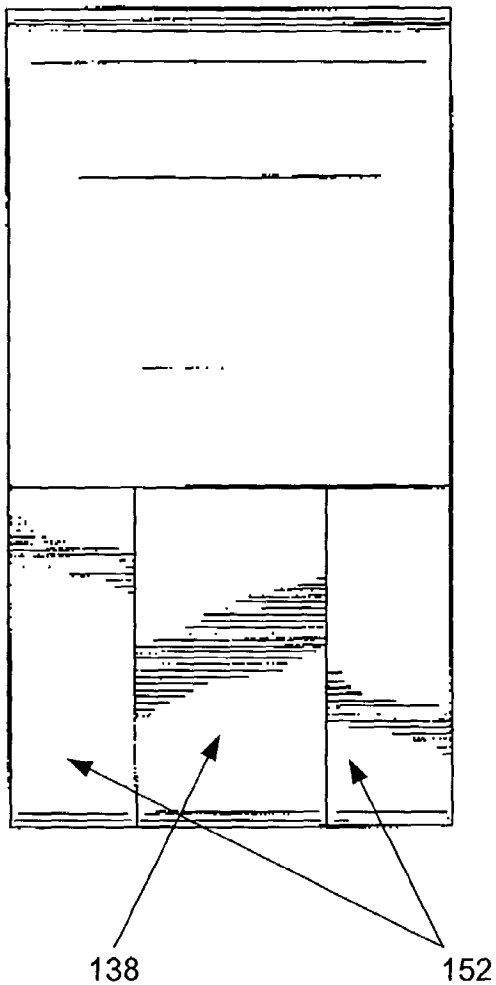
FIG. 14 is a rear elevational view of the example mounting clip shown in FIG. 8.

FIG. 14 is a rear elevation view of the example mounting clip 112 shown in FIG. 8. FIG. 14 illustrates that the interface section 138 in this embodiment extends from the front to the rear side of the base section 152 of the mounting clip 112. While in the illustrated embodiment, the interface section 138 extends from the front portion to the rear portion of the base section 152 of the mounting clip 112 and from the top portion to the bottom portion of the base section 152 of the mounting clip 112, it is not necessary that the interface section 138 extend entirely through the base section 152 of the mounting clip 112.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A loudspeaker system comprising:

a loudspeaker having a loudspeaker housing;

a mounting mechanism for mounting the loudspeaker housing to a structure, where the mounting mechanism includes:

a shaft for coupling the mounting mechanism to the loudspeaker housing;

an arm member including a base section;

an interface section substantially located in a region of the base section;

a post extending through the base section and the interface section along an axis generally orthogonal to a mounting direction; and a spring mechanism affixed to the post and contacting the arm member for biasing the arm member into engagement with the structure, where the arm member is pivotably coupled to the interface section for rotation about the post, the arm member being pivotally rotatable independent of any movement of the shaft; and where the interface section and the arm member via the interface section are movably coupled to the shaft and adjustable generally along the mounting direction.

2. The loudspeaker system of claim 1 where the shaft threadedly engages the interface section and a position of the arm member and interface section is adjustable generally along the mourning direction through rotation of the shaft.

3. The loudspeaker system of claim 1 where the interface section has a bore and the shaft is disposed in the bore.

4. The loudspeaker system of claim 3 where the shaft movably engages the bore for adjusting a position of the mounting mechanism relative to the loudspeaker housing.

5. The loudspeaker system of claim 1 where the arm member comprises an attachment edge for engaging the structure.

6. The loudspeaker system of claim 5 where the attachment edge comprises a toothed surface.

7. A loudspeaker system comprising:

a loudspeaker;

a loudspeaker housing adapted for insertion into the opening of a structure along a mounting direction;

a mounting assembly for mounting the loudspeaker housing in the opening;

a mounting mechanism coupled to the housing and including:

an arm member including a base section;

an interface section substantially located in a region of the base section;

a post extending through the base section and the interface section along an axis generally orthogonal to the mounting direction; and a spring mechanism affixed to the post and contacting the arm member for biasing the arm member into engagement with the structure, where the arm member is pivotably coupled to the interface section for rotation about the post between a first position and a second position, and where at the first position the arm member enables insertion of the loudspeaker housing in the opening, and at the second position the arm member extends generally away from the housing into engagement with a surface of the structure defining the opening; and where the spring mechanism biases the arm member toward the second position; and a shaft interconnecting the mounting mechanism and the loudspeaker housing, where the arm member of the mounting mechanism is pivotal between the first position and the second position independent of any movement of the shaft.

8. The loudspeaker system of claim 7 where the mounting mechanism is movably coupled to the shaft for adjusting a position of the arm member relative to the loudspeaker housing along the mounting direction.

9. The loudspeaker system of claim 8 where the mounting mechanism comprises an interface section movably coupled to the shaft and the arm member is pivotably coupled to the interface section via the post and spring mechanism.

10. A loudspeaker system comprising:

a loudspeaker housing;

a shaft, and a mounting mechanism comprising an arm member, an interface section, and a post extending through the arm member and the interface section along an axis generally orthogonal to a mounting direction and a spring mechanism positioned on the post and contacting the arm member for biasing the arm member in a locked position, where the arm member is pivotably coupled to the interface section for rotation about the post, the arm member being pivotally rotatable independent of any movement of the shaft; and where the interface section and the arm member via the interface section are movably coupled to the shaft and adjustable generally along the mounting direction.

11. The loudspeaker system of claim 10 where the shaft threadedly engages the interface section and a position of the arm member and interface section is adjustable generally along the mounting direction through rotation of the shaft.

12. The loudspeaker system of claim 10 where the interface section has a bore and the shaft is disposed in the bore.

13. The loudspeaker system of claim 12 where the shaft movably engages the bore for adjusting a position of the mounting mechanism relative to the loudspeaker housing.

14. The loudspeaker system of claim 10 where the arm member comprises an attachment edge for engaging the structure.

15. The loudspeaker system of claim 14 where the attachment edge comprises a toothed surface.

16. The loudspeaker system of claim 1 where the base section includes a first portion and a second portion and the interface section is substantially located between the first portion and the second portion of the base section.

17. The loudspeaker system of claim 1 where the interface section is substantially located in a central cavity of the base section.

18. The loudspeaker system of claim 1 where the shaft extends through the interface section and the base section.

* * * * *

UNITED STATES PATENT AND TRADEMARK OFFICE

CERTIFICATE OF CORRECTION

PATENT NO. : 7,731,130 B2
APPLICATION NO. : 10/632433
DATED : June 8, 2010
INVENTOR(S) : Decanio et al.

It is certified that error appears in the above-identified patent and that said Letters Patent is hereby corrected as shown below:

At column 6, line 25, "The top the extended..." should be changed to "The top of the extended..."

At column 7, line 38, claim 2, "along the mourning direction..." should be changed to "along the mounting direction..."

Signed and Sealed this

Fourteenth Day of September, 2010

David J. Kappos

David J. Kappos
*Director of the United States Patent and Trademark Office*